US006840823B2

(12) United States Patent
Eschermann et al.

(10) Patent No.: US 6,840,823 B2
(45) Date of Patent: Jan. 11, 2005

(54) ELECTROMAGNETIC PROTECTION AND CONTROL ASSEMBLY

(75) Inventors: Guy Eschermann, Chevigny-Saint-Sauveur (FR); Patrick Larcher, Ahuy (FR); Alain Moreux, Dijon (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 10/460,413

(22) Filed: Jun. 13, 2003

(65) Prior Publication Data

US 2004/0042148 A1 Mar. 4, 2004

(30) Foreign Application Priority Data

Jun. 25, 2002 (FR) ..... 02 07964

(51) Int. Cl.[7] ..... H01R 4/36
(52) U.S. Cl. ..... 439/811
(58) Field of Search ..... 439/811, 712, 439/714, 722, 727, 717; 361/115, 627

(56) References Cited

U.S. PATENT DOCUMENTS

| | | | | | |
|---|---|---|---|---|---|
| 3,702,457 | A | * | 11/1972 | Fujita | 439/687 |
| 4,171,862 | A | * | 10/1979 | Krasser | 439/717 |
| 4,527,849 | A | * | 7/1985 | Marach | 439/591 |
| 4,606,592 | A | * | 8/1986 | Neff | 439/586 |
| 4,872,855 | A | * | 10/1989 | Norden | 439/717 |
| 5,427,550 | A | * | 6/1995 | Jaag | 439/709 |
| 5,606,299 | A | * | 2/1997 | Innes et al. | 335/202 |
| 5,870,277 | A | * | 2/1999 | Girard et al. | 361/627 |
| 5,870,278 | A | * | 2/1999 | Girard et al. | 361/627 |
| 5,873,753 | A | * | 2/1999 | Norris et al. | 439/752 |
| 6,127,748 | A | * | 10/2000 | Girard et al. | 307/139 |
| 6,262,497 | B1 | * | 7/2001 | Muroi et al. | 307/139 |
| 6,262,880 | B1 | * | 7/2001 | Fischer et al. | 361/652 |

FOREIGN PATENT DOCUMENTS

| | | |
|---|---|---|
| DE | 224 150 | 6/1985 |
| DE | 84 34 232 | 12/1989 |
| EP | 0 588 712 | 3/1994 |
| EP | 0 592 829 | 4/1994 |
| EP | 1 014 414 | 6/2000 |
| WO | WO 00/46880 | 8/2000 |
| WO | WO 01/65126 | 9/2001 |

OTHER PUBLICATIONS

U.S. patent application Ser. No. 10/460,413, Eschermann et al., filed Jun. 13, 2003.

U.S. patent application Ser. No. 10/460,406, Garcia et al., filed Jun. 13, 2003.

* cited by examiner

*Primary Examiner*—Phuong Dinh
(74) *Attorney, Agent, or Firm*—Oblon, Spivak, McClelland, Maier & Neustadt, P.C.

(57) ABSTRACT

A protection and control assembly includes a power terminal block having openings, and electrical switch devices having input side conducting connection strips and output side conducting connection strips that project from a horizontal connection area on the input side and output side, respectively, of the electrical switch devices along a vertical axis. The electrical switch devices are positioned adjacent to each other along a direction parallel to the vertical axis, and the power terminal block makes the electrical connection by clamping the output side conducting connection strips of a first electrical switch device with the input side conducting connection strips of a second electrical switch device.

8 Claims, 2 Drawing Sheets

FIG. 3
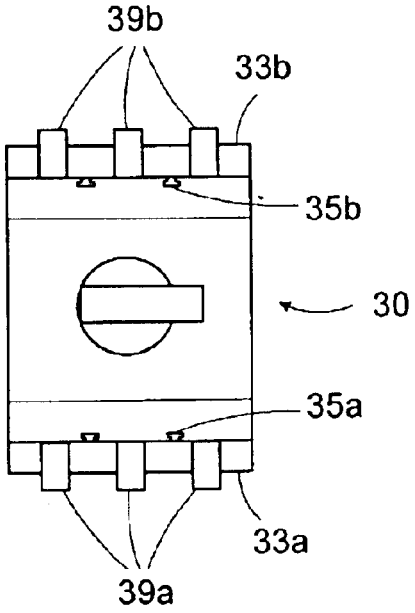
FIG. 4
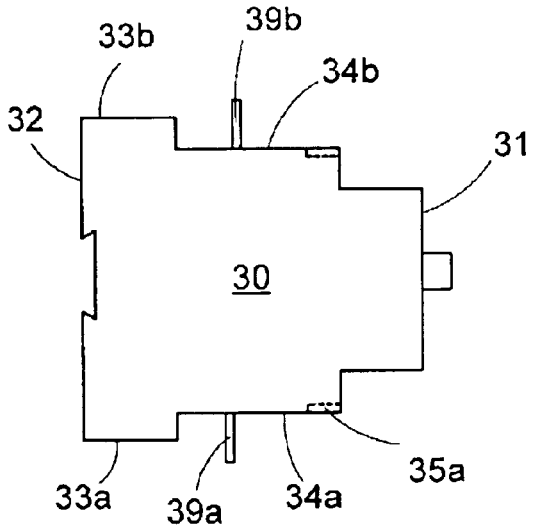
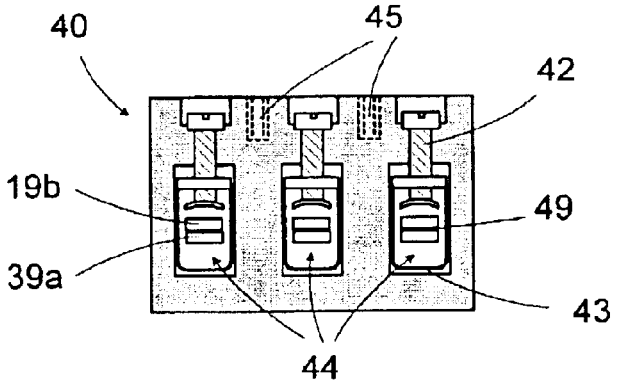
FIG. 5
A-A
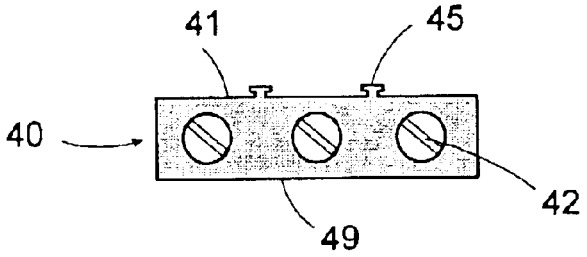
FIG. 6

ELECTROMAGNETIC PROTECTION AND CONTROL ASSEMBLY

BACKGROUND OF THE INVENTION

1. Field of the Invention

This invention relates to an electromagnetic protection and control assembly enabling mechanical attachment and electrical connection of several electrical switch devices, particularly for making an assembly comprising a combination of at least two electrical devices such as a contactor, a circuit breaker, an isolating switch, a fused isolating switch, a thermal relay or any other similar electrical device that can be used for low voltage electrical distribution or control. The invention also relates to an electrical device that could be used in the composition of such a protection and control assembly.

2. Discussion of the Background

In an assembly intended for the protection and control of an electrical motor (usually called a "motor start assembly") or any other low voltage multipole electrical load, a first electrical protection device such as a circuit breaker or a fused isolating switch is frequently used in cascade with a second electrical control device such as a contactor, these two devices being connected to each other. Other devices such as a thermal protection relay can also be added to this combination.

It is desirable to be able to make such a motor start assembly as easily and quickly as possible, while maintaining a dependable connection. For obvious reasons of cost and time saving during assembly/wiring and space saving in electrical boxes or cabinets in which the assembly is installed, an attempt is made particularly to eliminate any conductors (wires, bars) forming connections between the devices to minimise the number of electrical connections to be made and to minimise the total size of the different associated devices.

Solutions are already available, particularly in document EP0588712, in which a specific part is fitted between the two electrical devices and that integrates rigid conductors so that connections can be made to the corresponding terminal blocks on the two electrical devices, in order to make mechanical and electrical connections more quickly. However, this solution requires a connection operation on the terminal blocks of the two devices and it may also be necessary to separate the two devices from each other in order to insert this part.

Document WO0046880 describes a system in which the electrical devices comprise terminal blocks provided with elastic terminals in which an interconnection block is inserted between the two devices directly from the front. The system also comprises complementary mechanical attachment means on the two devices in order to complete their mechanical attachment. However, this solution is not suitable for screw terminals frequently used particularly in devices used to switch a high power electrical current, for example equal to or more than 32A at 400V. Furthermore, the interconnection block requires the presence of a specific terminal block on each unit.

SUMMARY OF INVENTION

Therefore, the purpose of the invention is to facilitate placement of a mechanical and electrical combination of several electrical devices in cascade in order to make a simple, reliable and economic connection of a protection and control assembly.

To achieve this, the invention describes a protection and control assembly comprising a first electrical switch device and a second electrical switch device, each having a box provided with input side and output side conducting connection strips that project from a horizontal connection area on the input side, and output side respectively, of each box along a vertical axis and that can be inserted in openings of removable power terminal blocks. The electrical devices is placed adjacent to each other along a direction parallel to the vertical axis. The protection and control assembly comprises a common removable power terminal block that makes the electrical connection by clamping the output side connection strips of the first electrical device with the corresponding input side connection strips of the second electrical device, thus providing a mechanical attachment between the two electrical devices.

According to one special feature, the box on the first electrical device comprises a horizontal output side support area that is forced into contact with a horizontal input side support area of the box of the second electrical device.

According to another special feature, the output side connecting strips of the first electrical device are offset from the input side connecting strips of the second electrical device, along a direction perpendicular to the vertical axis of the contact strips. The removable terminal blocks are identical and interchangeable and are provided with support devices that cooperate with complementary means arranged in the boxes of the electrical devices.

Thus according to the invention, the global dimensions occupied by the assembly formed from the two electrical devices are optimised since one is placed on the other, and the assembly and wiring of the assembly are simplified because there is only one common terminal block between the boxes of the two devices to make the electrical connection and the mechanical attachment of the two devices.

Another purpose of the invention is to propose an electrical switch device that can be integrated in a protection and control assembly like that described in the invention. This device comprises a box provided with input side and output side connection conducting strips that project along a vertical axis on a horizontal connection area on the input side and output side respectively, of the box and that can be inserted in openings of removable power terminal blocks. According to one special feature, the output side connection strips of the electrical device are offset from the input side connection strips of the electrical device along a direction perpendicular to the vertical axis. The invention also describes a power terminal block that can be integrated into such a protection and control assembly.

BRIEF DESCRIPTION OF THE DRAWINGS

Other characteristics and advantages will appear in the detailed description given below with reference to an embodiment given as an example and shown in the attached drawings in which:

FIG. 3 shows a front view of a box of an electrical switch device used in the composition of an assembly according to FIG. 1, FIG. 4 shows a side view of FIG. 3, FIG. 5 shows details of a removable terminal block according to section A—A in FIG. 1, FIG. 6 shows a front view of the terminal block in FIG. 5.

DESCRIPTION OF EMBODIMENTS

Figure 1:
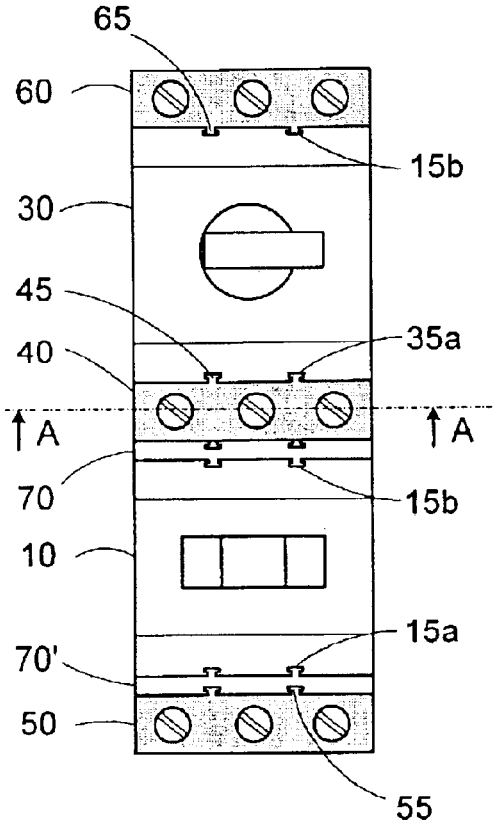
FIG. 1 diagrammatically shows a front view of an example of a protection and control assembly including two electrical devices.
Figure 2:
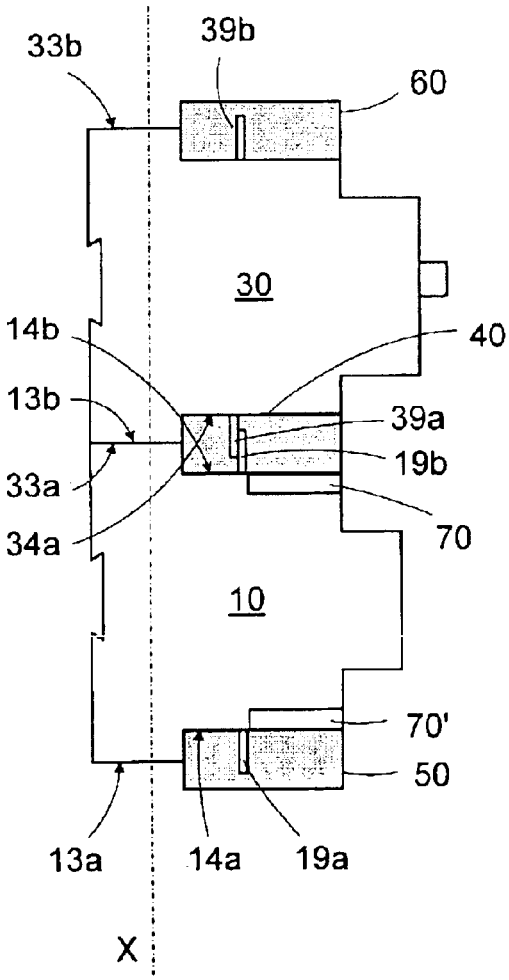
FIG. 2 shows a side view of the device shown in FIG. 1, which also shows conducting connection strips of the two electrical devices.

FIGS. 1 and 2 show an example embodiment of a protection and control assembly according to the invention. This assembly comprises at least two electrical devices, in this case a circuit breaker and a contactor. Similarly, the invention provides a means of making an assembly with more than two electrical devices, for example three devices—a circuit breaker, a contactor and a thermal relay as described later. It is also clear that the invention could also be applicable to any other electrical device that could be used for low voltage electrical distribution or control.

FIGS. 3 and 4 show a multipole electrical switch device, for example of the circuit breaker type, that can be integrated into such a protection and control assembly. The electrical device comprises a globally parallelepiped shaped box 30 with a front face 31 that can comprise a maneuvering device opposite to a back face 32 that can comprise means of attachment of the device onto a frame, a section and/or a board. The box 30 also has a horizontal input side face 33*b*,34*b* opposite a horizontal output side face 33*a*,34*a*. Conducting connection strips on the input side 39*b* project on the horizontal input side face 33*b*,34*b* of the box 30 along a vertical X axis and output side connection conducting strips 39*a* project on the horizontal output side face 33*a*,34*a* of the box 30 along the same vertical X axis but in the opposite direction. Obviously, an input side connection strip and an output side connection strip correspond to each pole of the switch device, and will be used to carry electrical current into and out of this pole. The examples shown in the figures contain three input side and three output side connecting switches, thus diagrammatically representing three-pole devices. In one preferred embodiment of the invention, the switch device is provided with rigid conducting strips 39*a*,39*b*, with an identical rectangular cross section sufficiently large for the circulation of a high power current, for example equal to or greater than 32 A at 400V. The conducting strips are normally made of metal, and particularly copper.

Preferably, the horizontal output side face 33*a*,34*a* and the horizontal input side face 33*b*,34*b* of the box 30 are formed by several horizontal planes offset from each other. Thus, the horizontal output side face 33*a*,34*a* is composed of at least one horizontal output side support area 33*a* and an offset horizontal output side connection area 34*a* from which the output side conducting strips 39*a* project. Similarly, the horizontal input side face 33*b*,34*b* is composed of at least one horizontal input side support area 33*b* and an offset horizontal output side connection area 34*b* from which the input side conducting strips 39*b* project. The output side support area 33*a* and input side support area 33*b* are closer to the back face 32 of the box 30 and the distance between them is greater than the distance between the output side connection area 34*a* and the input side connection area 34*b*.

The output side connection area 34*a* and the input side connection area 34*b* of the box 30 are arranged so that a removable power terminal block 40 can be placed in each of them, so as to enable an electrical connection between the connection strips 39*a*,39*b* of the box 30 with outside conductors. Obviously, the number of power terminals in this type of power terminal block 40, shown in FIGS. 5 and 6, is the same as the number of poles in the switch device on which it will be installed. It is parallelepiped shaped with two opposite horizontal faces 41,49 and a vertical front face through which the terminal clamping screws 42 are accessed. For each terminal in the power terminal block 40, there is a vertical opening 44 through which the horizontal faces 41,49 pass through which one or several electrical conductors can pass perpendicular to the line of the screws 42. The width of a terminal block 40 is approximately equal to the width of the box 30.

Thus, each connection strip 39*a*,39*b* is inserted in a corresponding opening 44 when one of the horizontal faces 41,49 of a connection terminal block 40 is in contact with a connection area 34*a*,34*b* of the box 30. Conventionally, each terminal of a power terminal block 40 comprises a clamping screw 42 that cooperates with a clamping cage 43 located in the corresponding opening 44 in the terminal. When the screw 42 is tightened, the cage 43 is deformed so that it clamps the conductors present in the opening 44. This clamping makes an efficient electrical connection between the connection strip and any other conductor that is already in the opening 44, and also fixes the connection terminal block 40 to the box 30 of the switch device.

Furthermore, at least one of the horizontal faces 41,49 of the power terminal block 40 is provided with support devices 45, to facilitate guidance, positioning and support of power terminals 40 on the box 30 of the electrical device. These support devices 45 are designed so that they can cooperate with complementary means on the output and input sides 35*a* and 35*b*, arranged on the output and input side connection areas 34*a* and 34*b* respectively, of box 30.

According to one preferred embodiment, these support devices consist of one or several pins 45 present on a front part of the horizontal face 41 of the power terminal block 40. When the power terminal block 40 is installed in contact with the box 30, these pins are inserted in the corresponding number of cavities 35*a*,35*b* present on the front part of the connection areas 34*a*,34*b* of the box 30. Preferably, the shape of the cavities 35*a*,35*b* is complementary to the shape of the pins 45. Once the connection strips 39 have been engaged in the openings 44 and before the screws 42 have been tightened, the terminal block 40 is put into its permanent position by sliding the horizontal face 41 backwards along the connection area 34*a*,34*b* of the box 30 until it stops in contact with the support area 33*a*,33*b*. During this operation, the pins 45 are engaged in the corresponding cavities 35*a*,35*b* contributing to holding the terminal block in place and positioning it adjacent to the box.

The removable power terminal block 40 is advantageously symmetric about a median vertical plane so that a single terminal block 40 can be installed indifferently on the output side of a box 30, or on the input side after turning it around. In the examples given, the horizontal face 41 is provided with two pins 45 located on each side of the vertical median plane.

With reference to FIGS. 1 and 2, the protection and control assembly described in the invention comprises a first electrical switch device like that described above and a second electrical switch device. In the same way as for the first electrical device 30, this second electrical device comprises a globally parallelepiped shaped box 10 comprising a horizontal input side face 13*b*,14*b* opposite a horizontal output side face 13*a*,14*a*. The width of the box 10 of the second device is equal to approximately the width of the box 30 of the first device. Conducting connection strips on the input side 19*b* and output side 19*a* project on the input and output sides respectively of the horizontal face of the box 10, along a vertical X axis. The horizontal output side face 13*a*,14*a* consists of at least one horizontal output side support area 13*a* and an offset horizontal output side connection area 14*a* from which the output side connection strips 19*a* project. Similarly, the horizontal input side face 13*b*,14*b* is composed of at least one horizontal input side support area 13*b* and an offset horizontal input side connection area 14*b* from which the input side connection strips 19*b* project. The output side and input side support areas 13*a* and 13*b* are closer to the back face of the box 10 and are further from each other than the output side and input side connection areas 14*a* and 14*b*. Cavities 15*a*,15*b*, similar to cavities 35*a*,35*b*, are arranged on a front part of the input side and output side connection areas 14*a* and 14*b* of the box 10, into which the power terminal block support pins fit.

Once the protection and control assembly has been assembled, the boxes 30 and 10 are arranged on top of the other along a direction parallel to the vertical X axis of the connection strips such that the output side support area 33*a* of the box 30 of the first electrical device is in contact with the input side support area 13*b* of the box 10 of the second electrical device. Therefore the vertical dimensions of the protection and control assembly are minimum since the boxes of the two electrical devices are directly in contact, with no space between them.

A removable output side power terminal block 50 is installed on the output side of the assembly, in contact with the output side connection strip 14*a* of the second box 10. The screws of this output side terminal block 50 are tightened to fix this terminal block in contact with the box 10 and to electrically connect the output side connection strips 19*a* to external output side conductors. Similarly, a removable input side power terminal block 60 is installed on the input side of the assembly, in contact with an input side connection area 34*b* of the first box 30. The screws on the input side terminal block 60 are tightened to fix the terminal block 60 adjacent to the box 30 and electrically connect the input side connection strips 39*b* to external input side conductors. The power terminal blocks 50,60 are identical to the power terminal block 40 described above. The power terminal blocks 40,50,60 comprise support pins 45,55,65 that cooperate with complementary shaped cavities 35*a*,35*b*,15*a*,15*b* in boxes 30,10 to facilitate guidance, positioning and support of terminal blocks in contact with the boxes of the electrical devices.

The offset between the contact strip and the connection strip of the same horizontal face of a box is designed such that when the two boxes 30 and 10 are placed adjacent to each other through their support strip, the space created between the output side connection area 34*a* of the first box 30 and the input side connection area 14*b* of the second box 10 can be occupied by a removable common power terminal block 40. Advantageously, this common terminal block 40 is identical to the input side and output side power terminal blocks 60 and 50, thus reducing the number of different parts necessary to install the described assembly since all power terminal blocks 40,50,60 are interchangeable between each other. The support pins 45 of the common power terminal block 40 are associated with the cavities 35*a*,35*b* of the box 30. The common terminal block 40 could thus be turned over so that the support pins 45 can be associated with the cavities of the second box 10 (through a shim 70).

Thus, this type of protection and control assembly composed of two electrical devices only includes three power terminal blocks 40,50,60 while two terminal blocks are usually necessary per device.

The common power terminal block 40 fulfills several functions. Once the output side connection strips 39*a* of the first device and the input side connection strips 19*b* of the second device have been inserted in the openings 44 of the common terminal block 40, a clamping action on the three tightening screws 42 makes a two-to-two electrical connection of the output side connection strips 39*a* of the first device with the corresponding input side connection strips 19*b* of the second device. Similarly, this clamping action mechanically fastens the two devices to each other. Due to this mechanical attachment, only one of the devices, for example the first device 30, needs to be fixed through its back face 32 onto a support such as a frame, section or board, the other device being held in place only by the common terminal block 40. it is then very easy to assemble the two devices to each other before the assembly is attached to the support. Furthermore, only one support is then necessary to install the assembly.

The output side connection strips 39*a* of the first device are slightly offset from the input side connection strips 19*b* of the second device along a direction perpendicular to the vertical X axis of the connection strips, in order to make an efficient electrical connection and mechanical attachment between the two devices. In the examples shown in the diagrams, the output side connection strips 39*a* of the box 30 are offset backwards from the input side connection strips 19*b* of the box 10. Obviously, it would have been possible to offset them forwards, or even to offset the output side connection strips laterally from the input side connection strips.

This offset must be sufficient to not hinder the boxes 30 and 10 being put adjacent to each other when the assembly is put together. But this offset must enable the output side connection strips 39*a* of the first device to overlap and to be flush with the input side connection strips 19*b* of the second device, once the assembly has been installed and once the screws 42 of the common terminal block 40 have been tightened, to form an electrical contact area 49 as shown in 5. Furthermore, the length of the output side and input side connection strips is selected such that the overlap of the output side connection strips 39*a* of the first device and the input side connection strips 19*b* of the second device provide a sufficiently large contact area 49 to provide a reliable mechanical support and satisfactory electrician connection between the two devices, conform with the electrical current that might circulate through the protection and control assembly.

The invention thus provides means of making a protection and control assembly comprising more than two electrical devices. It is easy to add a third electrical device to the described assembly by keeping the same power terminal blocks 40,50,60. If the box of the third electrical device is placed on the output side of the box 10, for example as in the case of a thermal relay, it will be placed adjacent to the output side contact strip 13*a* of the box 10 and the power terminal 50 will act as a common terminal block between the boxes of the second and third devices. The connection strips on the output side of the third terminal block will then be designed to slightly offset from the output side connection strips of the second device. Conversely, if the third electrical device is on the input side of the box 30, it would be placed adjacent to the input side support area 33*b* and the power terminal block 60 would act as a common terminal block between the boxes of the first and third devices. The output side connection strips of the third device should then be slightly offset from the input side connection strips of the first device.

Furthermore, due to their construction, some switch devices may have an offset on the front part of the connection strip on their horizontal input and output side faces, in front of the outputs of the connection strips. Thus, according to the embodiment of the invention in FIGS. 1 and 2, the input side and output side connection areas 14*a* and 14*b* of the second electrical device are provided with such a setback immediately in front of the connection strips 19*a*,19*b*. To make the assembly described, this setback may be closed off by inserting a shim 70 or 70' between the box 10 and the power terminal block 40 or 50 respectively, so as to improve the support of the power terminal blocks 40,50 in contact with the box 10. These shims 70,70' are identical and symmetrical about a vertical median plane. They have a parallelepiped shape and are approximately equal to the setback and their width is approximately equal to the width of the boxes of the electrical devices. They can thus fill in the said setbacks without increasing the general dimensions of the assembly described in the invention. They comprise a first horizontal face presenting support pins that can cooperate with cavities 15*a*,15*b* of the box 10 and a second opposite horizontal face with cavities that can cooperate with support pins of adjacent power terminal blocks.

Obviously, it would be possible to imagine other variants and improvements to details, and even to envisage the use of equivalent means, without going outside the scope of the invention.

What is claimed is:

1. A protection and control assembly comprising:

a common removable power terminal block having openings; and first and second electrical switch devices each having a substantially box-shaped body having input side conducting connection strips and output side conducting connection strips, said input side conducting connection strips and said output side conducting connection strips projecting from a horizontal connection area on the input side and output side, respectively, of each of said first and second electrical switch devices along a vertical axis, and the output side conducting connection strips of the first electrical switch device and the input side conducting connection strips of the second electrical switch device configured to be inserted in corresponding openings of said common removable power terminal block, wherein said first and second electrical switch devices are positioned adjacent to each other alone a direction parallel to the vertical axis, and said common removable power terminal block is configured to make the electrical connection by clamping the output side conducting connection strips of the first electrical switch device with the corresponding input side conducting connection strips of the second electrical switch device to provide a mechanical attachment between the first and second electrical switch devices.

2. The protection and control assembly according to claim 1, wherein the first electrical switch device includes a horizontal output side support area configured to be in contact with a horizontal input side support area of the second electrical switch device.

3. The protection and control assembly according to claim 2, wherein the common power terminal block is positioned between the output side horizontal connection area of the first electrical switch device and the input side horizontal connection area of the second electrical switch device.

4. The protection and control assembly according to claim 1, wherein the output side conducting connection strips of the first electrical switch device are offset from the input side conducting connection strips of the second electrical switch device along a direction perpendicular to the vertical axis (X).

5. The protection and control assembly according to claim 1, further comprising a removable input side power terminal block configured to engage the input side conducting connection strips of the first electrical switch device, a removable output side power terminal block configured to engage the output side conducting connection strips of the second electrical switch device, the input side and output side power terminal blocks being substantially identical and interchangeable with the common power terminal block.

6. The protection and control assembly according to claim 5, wherein each of said common removable power terminal block, said removable input side power terminal block and said removable output side power terminal block includes support devices configured to engage with corresponding complementary devices provided in each of the first and second electrical switch devices.

7. The protection and control assembly according to claim 6, wherein the support devices include at least one pin provided on a horizontal surface of each of said common removable power terminal block, said removable input side power terminal block and said removable output side power terminal block.

8. The protection and control assembly according to claim 6, further comprising a shim configured to be inserted between one of said first and second electrical switch devices and said common removable power terminal block, the shim being provided with support devices configured to engage with the corresponding complementary devices of one of said first and second electrical switch devices.

* * * * *